US010167643B2

(12) United States Patent
Ferris

(10) Patent No.: US 10,167,643 B2
(45) Date of Patent: Jan. 1, 2019

(54) PROTECTO UNIT FOR A SLIDING DOOR FRAME

(71) Applicant: Rodney Kim Ferris, Naples, FL (US)

(72) Inventor: Rodney Kim Ferris, Naples, FL (US)

( * ) Notice: Subject to any disclaimer, the term of this patent is extended or adjusted under 35 U.S.C. 154(b) by 136 days.

(21) Appl. No.: 15/224,761

(22) Filed: Aug. 1, 2016

(65) Prior Publication Data

US 2018/0030747 A1 Feb. 1, 2018

(51) Int. Cl.
*E04G 21/30* (2006.01)
*E06B 1/70* (2006.01)
*E06B 3/46* (2006.01)

(52) U.S. Cl.
CPC ..... *E04G 21/30* (2013.01); *E06B 1/70* (2013.01); *E06B 3/46* (2013.01)

(58) Field of Classification Search
CPC ..... E06B 1/70; E06B 3/46; E06B 1/62; E06B 2001/622; E06B 1/64; E06B 7/16; E06B 7/231; E06B 7/2316; E06B 7/232; E04G 21/30
USPC ..... 49/468, 469; 52/207
See application file for complete search history.

(56) References Cited

U.S. PATENT DOCUMENTS 1,881,661 A * 10/1932 Kelly ..... E06B 7/22 49/469
3,114,943 A * 12/1963 Casebolt ..... E06B 3/4618 160/90
4,079,550 A * 3/1978 Bursk ..... E06B 1/70 428/344
5,469,666 A * 11/1995 Lewis, Jr. ..... E06B 1/70 49/467
9,873,595 B2 * 1/2018 Akin ..... B66B 13/301
2006/0053695 A1 * 3/2006 Palenske ..... E06B 1/70 49/468
2013/0091776 A1 * 4/2013 Van Camp ..... E06B 1/70 49/467
2013/0305610 A1 * 11/2013 Meeks ..... E06B 1/70 49/471
2015/0052820 A1 * 2/2015 Van Camp ..... E06B 1/70 49/468
2017/0204654 A1 * 7/2017 Heid ..... E06B 1/70
2017/0342764 A1 * 11/2017 Headrick ..... E06B 1/70

* cited by examiner

*Primary Examiner* — William V Gilbert
(74) *Attorney, Agent, or Firm* — Ronald C Capossela

(57) ABSTRACT

A protector for a sliding door frame includes an inverted U-shaped sill riser cover and a sill plate cover and means for snapping the two covers together to form a rigid unitary unit for protecting the sliding door frame during construction.

2 Claims, 3 Drawing Sheets

PROTECTO UNIT FOR A SLIDING DOOR FRAME

CROSS REFERENCE TO RELATED APPLICATIONS

Not applicable

STATEMENT REGARDING FEDERALLY SPONSORED RESEARCH OR DEVELOPMENT

Not applicable

NAMES OF THE PARTIES TO JOINT RESEARCH AGREEMENT

Not applicable

INCORPORATION-BY-REFERENCE OF MATERIAL SUBMITTED ON A COMPACT DISC OR AS A TEXT FILE VIA THE OFFICE ELECTRONIC FILING SYSTEM (EFS-WEB)

Not applicable

STATEMENT REGARDING PRIOR DISCOSURES BY THE INVENTOR OR A JOINT INVENTOR

Not applicable

SEQUENCE LISTING

Not applicable

BACKGROUND OF THE INVENTION

Field of the Invention

The present invention relates to a protective cover unit for sliding door frame used in commercial and residential entryways to be used during construction or renovation.

Background

Entryways in commercial and residential buildings serve several important purposes in their role as a transition from the exterior to the interior of the building. The primary goal of an entryway is to allow for ingress and egress while insulating the interior from the exterior. Entryways are intended to prevent intrusion of rainwater, the passage of air, transfer of heat and can enhance the appearance of the building. Once the building is "under roof" the windows and doors are installed in order to protect the interior thereof from the environment. This leaves the sliding door frame exposed to any damage from workers that remains within the building. Heavy traffic of workers entering the building, including the movement of equipment and materials, can often lead to severe damage to the sliding door frame.

Protective covers have been disclosed that are designed to temporarily remain on the sliding door frame during construction. Some have hinges which fasten to the door frame, others are blankets which cover the frame and others are metallic rigid ramps which overlie the door frame. The present invention provides a unique protector unit for the sliding door frame because of its two piece construction with means for rigidly connecting them together on the job site which is an improvement in the prior art.

SUMMARY OF THE INVENTION

The following presents a simplified summary of the invention in order to provide a basic understanding of the many aspects of the invention.

The present invention is concerned with protecting the frame of a sliding door during construction.

The primary object of the present invention is to provide a two piece protector for the base frame of the sliding door frame.

A further object of the present invention is to provide an inverted U-shaped element which is capable of covering the sill riser.

A further object of the present invention is to provide a flat flexible sill plate cover with sufficient width and length to cover the sill plate.

A further object of the invention is to provide means for connecting the sill riser cover with the sill plate cover to create a rigid unitary protector unit.

A further object of the present invention is to provide scoring marks on the sill riser cover.

A further object of the present invention is to provide a plurality of channel members protruding from the lower surface of the sill plate cover to give stability thereto.

A further object of the present invention is to provide an additional segment to abut edge to edge with the sill plate cover to give additional depth.

Another object of the present invention is to provide a protector for the sliding door frame having a vertical jamb component.

Another object of the present invention is to provide a protector for the sliding door edge.

These and other aspects of the present invention will become more apparent to those having ordinary skill in the art after reading the following description of the preferred embodiments of the present invention, when considered in conjunction with the accompanying formal drawings wherein the same reference numerals are used consistently throughout the many drawing figures. It should be understood that variations may be made in details and general features of the design without departing from the spirit and scope of the invention. In addition it is pointed out that the sill plate cover of the present invention is dimensioned such that it could be used to protect the vertical door jamb because the structure of the jamb would be similar as the sill plate. It could easily be screwed into the jamb and provide protection thereof. Likewise the sill riser cover could also be used to cover the edge of the sliding door.

DETAILED DESCRIPTION OF THE DRAWINGS

Figure 1:
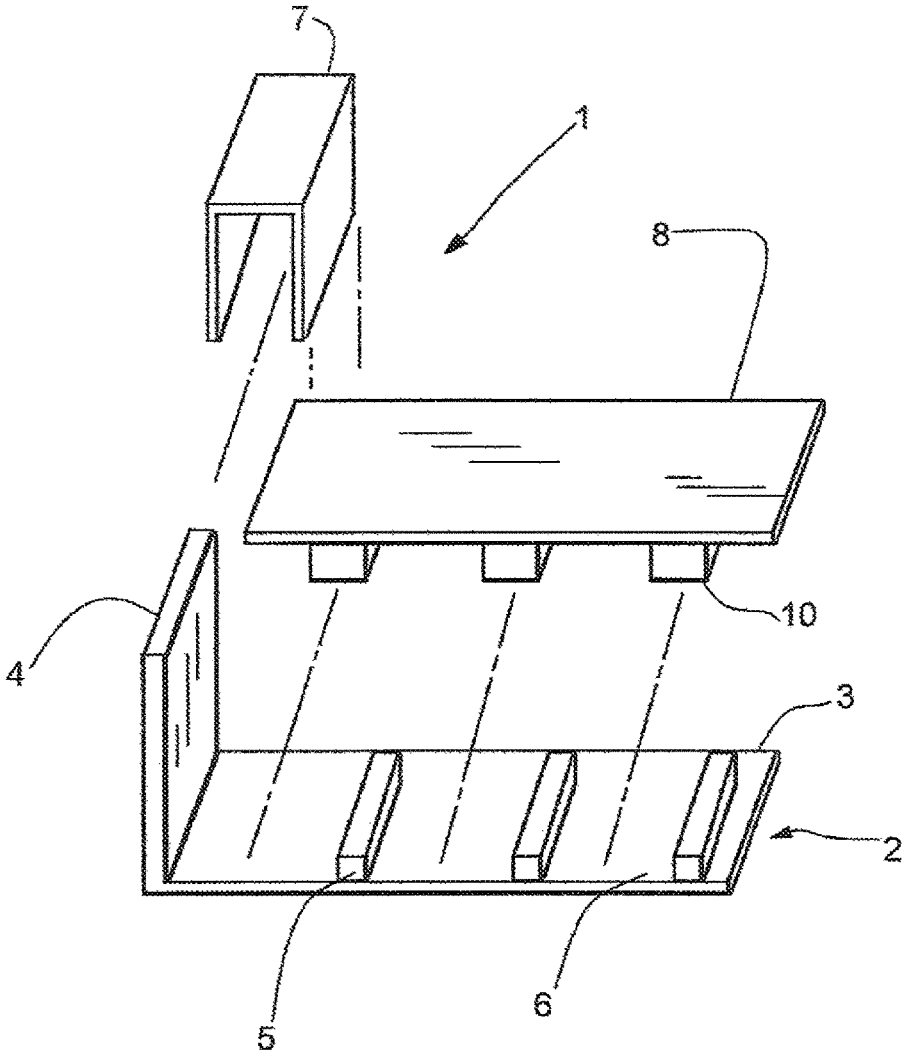
FIG. 1 is an exploded view of sliding door frame with the protector unit of the present invention.

FIG. 1 is a detailed exploded view of the preferred embodiment of the present invention which includes a protector unit 1 for a sliding door frame 2. The sliding door frame 2 consists of a sill plate 3 and a sill riser 4. The sill plate 3 is attached to the door entryway and has a plurality of tracks 5 for supporting the rollers at the base of the sliding doors. The number of tracks 5 would be equal to the number of sliding doors plus screen doors for a particular building arrangement. A channel space 6 is provided on either side of the tracks 5 for passage of the sliding doors. For example, if there were three sliding doors then there would be three tracks and four channel spaces. This is well known in the construction trades and is not considered part of the present invention. The sill riser 4 abuts the sill plate 3 and extends parallel thereto. The height of the sill riser 4 is driven by the design pressure measured in pounds per square foot of wind pressure on the sliding door assembly. During construction of a building, the sliding door frame 2 is installed between the supporting walls of a building. The sliding door frame 2 is exposed to damage by the mere moving of equipment in and out of the building through the entryway. The protector unit 1 of the present invention provides for a sill riser cover 7 and a sill plate cover 8 which are fastened together by connection means 9. The sill riser cover 7 is shown as an modified inverted U-shaped flexible member made of a rubberized plastic, cardboard or vinyl material which can be either molded or extruded and can be about $1/8^{th}$ of an inch thick. The sill plate cover 8 is flat planar flexible member having an upper surface 8*a* and a lower surface 8*b* which extends horizontally over the sill plate 3 and can be made of a rubberized plastic, cardboard or vinyl material which can be either molded or extruded and can be about ¼ of an inch thick. A plurality of channel members 10 extend from said lower surface 8*b* of the sill plate cover 8 and are seated within the channel spaces 6 between the tracks 5 which give stability to the sill plate cover 8.

Figure 2:
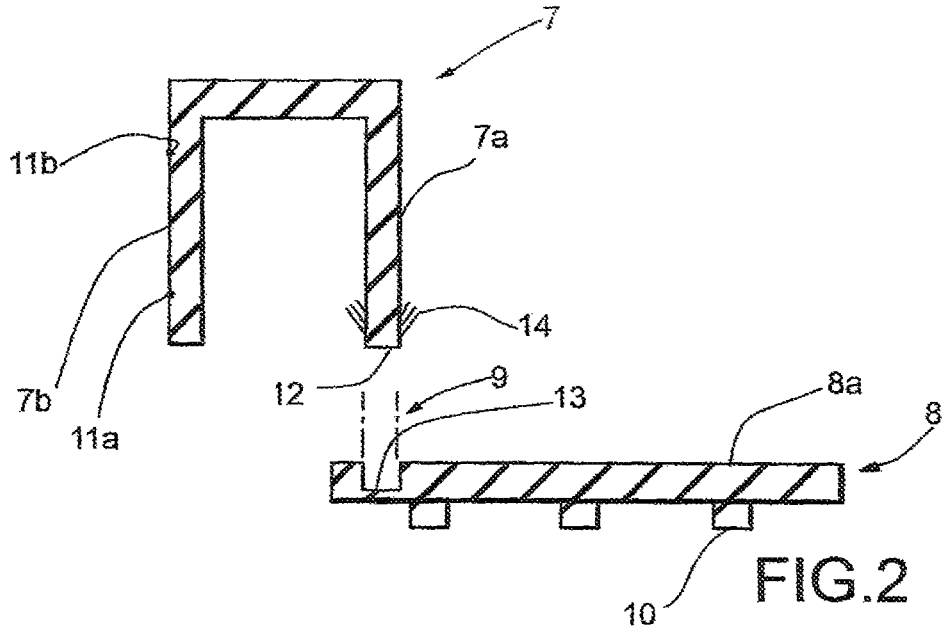
FIG. 2 is a detailed view of the connection means of the present invention.

FIG. 2 is a sectional view of the connection means 9 showing the detail of the sill riser cover 7 having a first leg 7*a* and a second leg 7*b* with the first leg 7*a* having an extension edge 12 capable of mating with a slot 13 on the upper surface 8*a* of the sill plate cover 8. The extension edge 12 has a plurality of splines 14 positioned thereon to insure a rigid snap fit into the slot 13. The second leg 7*b* has a plurality of score marks 11*a* and 11*b* positioned vertically thereon which can be easily cut when the carpet pad, carpet, wood flooring are laid. For example, once the carpet and carpet pad were installed, the sill riser cover 7 would be cut at score mark 11*a*. If wood flooring was laid then the sill riser cover 7 would be cut at score mark 11*b*.

Figure 3:
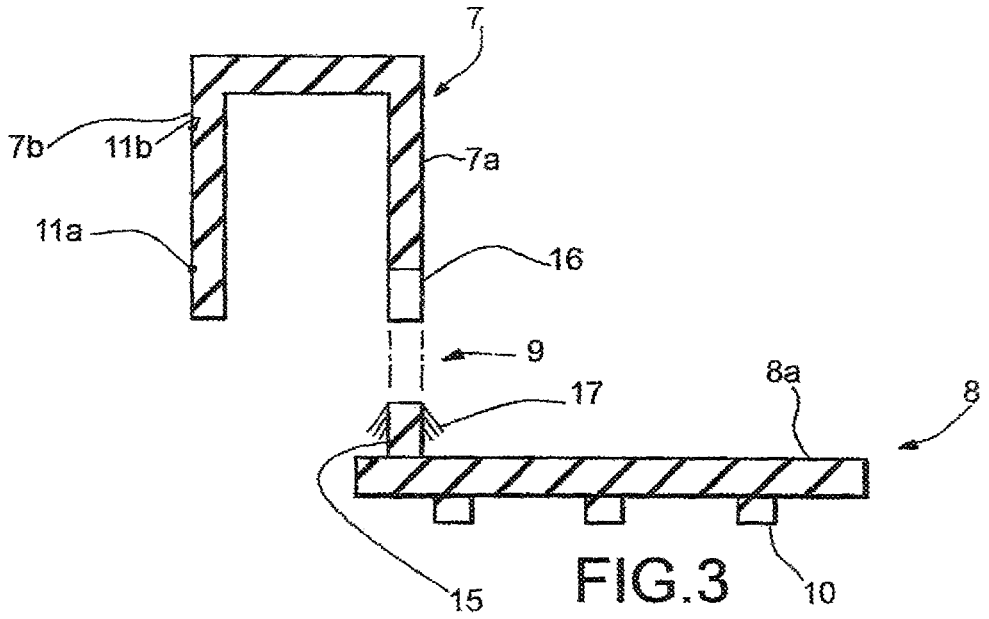
FIG. 3 is a detailed view of another embodiment of the connection means.

FIG. 3 is a sectional view of the connection means 9 showing the detail of the sill riser cover 7 having a first leg 7*a* and a second leg 7*b* and wherein the first leg 7*a* having a recess 16 which can easily mate with a finger 15 extending upwardly from the upper surface 8*a* of sill plate cover 8. The finger 15 can have a plurality of splines 17 thereon to insure a rigid snap fit into the recess 16 within the sill riser cover 7. For example, once the carpet and carpet pad were installed, the sill riser cover 7 would be cut at score mark 11*a*. If wood flooring was laid then the sill riser cover 7 would be cut at score mark 11*b*.

Figure 4:
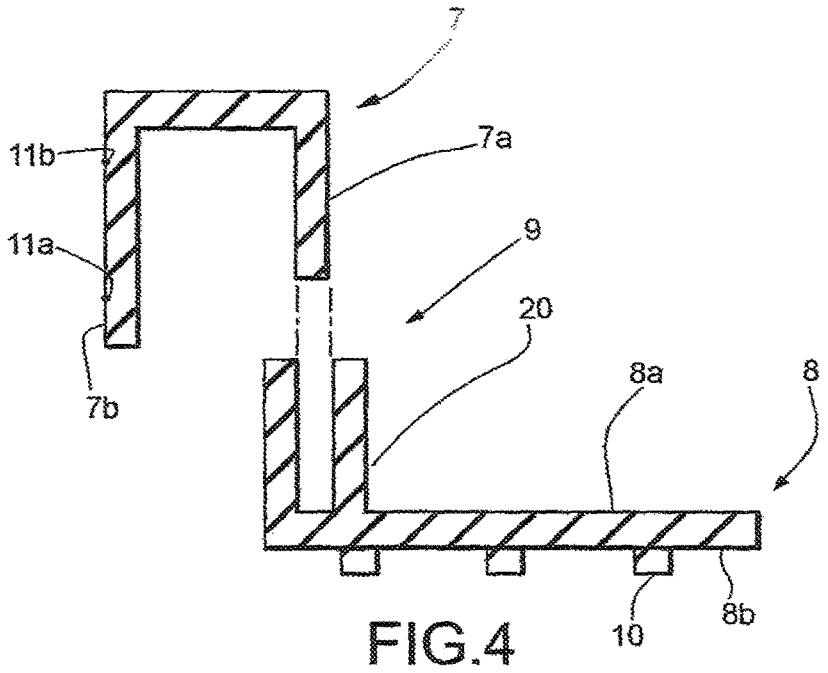
FIG. 4 is a detailed view of still another embodiment of the connection means.

FIG. 4 is a sectional view of the connection means 9 including the sill riser cover 7 having a first leg 7*a* and a second leg 7*b*. The first leg 7*a* is inserted into the groove 20 defined by a pair of walls extending upwardly from the upper surface 8*a* of the sill plate cover 8 and a second leg 7*b* positioned on the "room side" of the sill riser 4. For example, once the carpet and carpet pad were installed, the sill riser cover 7 would be cut at score mark 11*a*. If wood flooring was laid then the sill riser cover 7 would be cut at score mark 11*b*.

Figure 5:
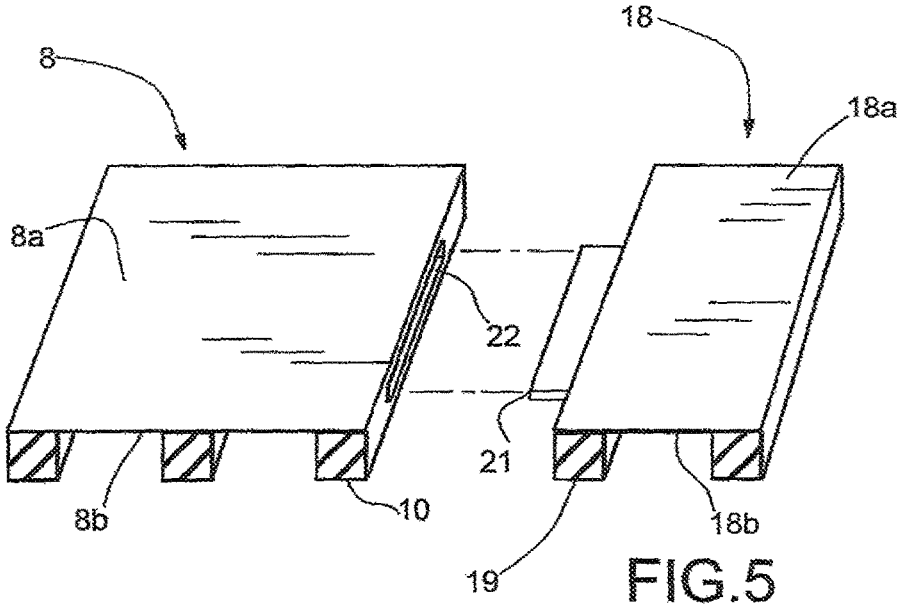
FIG. 5 is a detailed view of an additional segment connected to the sill plate cover.

FIG. 5 is a sectional view of the sill plate cover 8 having a plurality of channel members 10 extending from the lower surface 8*b* thereof. An additional segment 18 is provided with additional channel members 19 extending from the lower surface 18*b* and having a protuberance 21 capable of mating with opening 22 on the channel member 10. It is contemplated that this design could take on many different alternatives; for example, the opening 22 on channel member 10 could run the entire length thereof with the protuberance 21 running the entire length of the additional channel member 19. Openings 22 could be designed as a plurality of openings spaced along the channel member 10. Of course the protuberance 21 would be designed accordingly to mate the channel member 10 with the additional channel member 19. As another alternative, the protuberance 21 could extend from the channel member 10 with the openings 22 formed in the additional channel member 19.

The invention claimed is:

1. A protector unit adapted to protect a sliding door frame having a sill plate and a sill riser and wherein the sill plate has a plurality of roller tracks comprising: a sill plate cover having an upper surface and a lower surface and a sill riser cover, a first connection element positioned on said upper surface of said sill plate cover and a second connection element positioned on said sill riser cover such that when the first connection element is mated with the second connection element a rigid unitary protector unit is formed to protect the sliding door frame, wherein the sill riser cover is an inverted U-shaped flexible member having a first leg and a second leg, said first connection element positioned on said sill plate cover is a groove defined by a pair of walls extending upwardly from the upper surface thereof and said second connection element of the sill riser cover is the first leg of the sill riser cover wherein the first leg slides into the groove on the sill plate cover, and wherein the sill plate cover has a plurality of channel members extending from the lower surface thereof for stabilizing the protector unit when placed on the sill plate and wherein said plurality of channel members correspond to said plurality of roller tracks on the sill plate.

2. The protector unit of claim 1 wherein scoring marks are provided on the second leg of said sill riser cover for facilitating cutting thereof.

* * * * *